US005618121A

United States Patent [19]

Hsu

[11] Patent Number: 5,618,121

[45] Date of Patent: Apr. 8, 1997

[54] FILE CLIP WITH PUNCHING FUNCTION

[75] Inventor: Walter W. Hsu, Yinlin Hsien, Taiwan

[73] Assignee: Welter's Co., Ltd., Yinlin Hsien, Taiwan

[21] Appl. No.: 535,959

[22] Filed: Sep. 28, 1995

[51] Int. Cl.[6] ..... B42F 3/04

[52] U.S. Cl. ..... 402/1; 402/34

[58] Field of Search ..... 402/4, 1, 31, 32, 402/34, 38; 831/375, 453, 618; 7/158, 160

[56] References Cited

U.S. PATENT DOCUMENTS

| | | | |
|---|---|---|---|
| 435,412 | 9/1890 | Fish | 402/34 X |
| 448,149 | 3/1891 | Henson | 402/34 X |
| 471,087 | 3/1892 | Ahrens et al. | 402/34 X |
| 926,261 | 6/1909 | Krag | 83/618 X |
| 1,152,886 | 9/1915 | Dom | 83/618 X |
| 1,154,294 | 9/1915 | Dom | 83/618 X |
| 4,466,322 | 8/1984 | Mori | 83/640 |
| 4,802,789 | 2/1989 | Hsu | 402/1 |

*Primary Examiner*—Frances Han
*Attorney, Agent, or Firm*—Browdy and Neimark

[57] ABSTRACT

A file clip having a punching function, includes a base board, a paper hanging member, a leaf spring for fixing the paper hanging member, a paper clip member, two locating springs for locating the paper clip member, a wave spring, two punching rods, two extension springs and two transparent plastic caps. The base board is formed with a pivot channel for pivotally receiving the paper hanging member that has two punching sections at two ends and a middle lug section. A fixing dent is formed in front of a fixing recess which is formed at an upper middle section of the base board for fixing the paper hanging member. Two fixing holes are formed on the rear end of the base board for fixing the file clip. A notch is formed at a middle section of the front end of the base board. Two locating channels are on both sides of the notch for pivotally connecting the paper clip member. Two punching seats extend downward from each punching hole that is formed on the base boards. A cavity is formed at a top edge of each punching seat and a through hole is formed on a bottom face thereof. Two tenons are disposed on the bottom face of the base board. The wave spring is formed with two fixing circles at two ends and a middle depression hanging hook. The punching rod has an upper large diameter formed with a groove and a lower small diameter formed with a rib.

2 Claims, 8 Drawing Sheets

FILE CLIP WITH PUNCHING FUNCTION

BACKGROUND OF THE INVENTION

The present invention relates to a file clip with punching function, which can directly punch a paper itself without using any punching device and then collect the paper on the file clip. The file clip has relatively large opening so that the paper can be more easily collected or taken out.

A conventional file clip only has the function of collecting papers. The papers to be collected are first punched with through holes by a punching device and then collectively fitted with the file clip. When additional papers are added to the file, these papers must be similarly punched with holes and then the file clip is opened for adding these papers to the file. Then the file clip is again closed. This procedure is quite troublesome. Moreover, in an open state, the conventional file clip often has such a small opening that it is difficult to place the papers in or take the paper out of the file clip.

SUMMARY OF THE INVENTION

It is therefore a primary object of the present invention to provide a file clip with punching function, which can directly punch a paper itself without using any punching device and then collect the paper on the file clip.

It is a further object of the present invention to provide the above file clip which has relatively large opening so that the paper can be more easily placed in and collected or taken out.

The present invention can be best understood through the following description and accompanying drawings, wherein:

DETAILED DESCRIPTION OF THE PREFERRED EMBODIMENT

Figure 1:
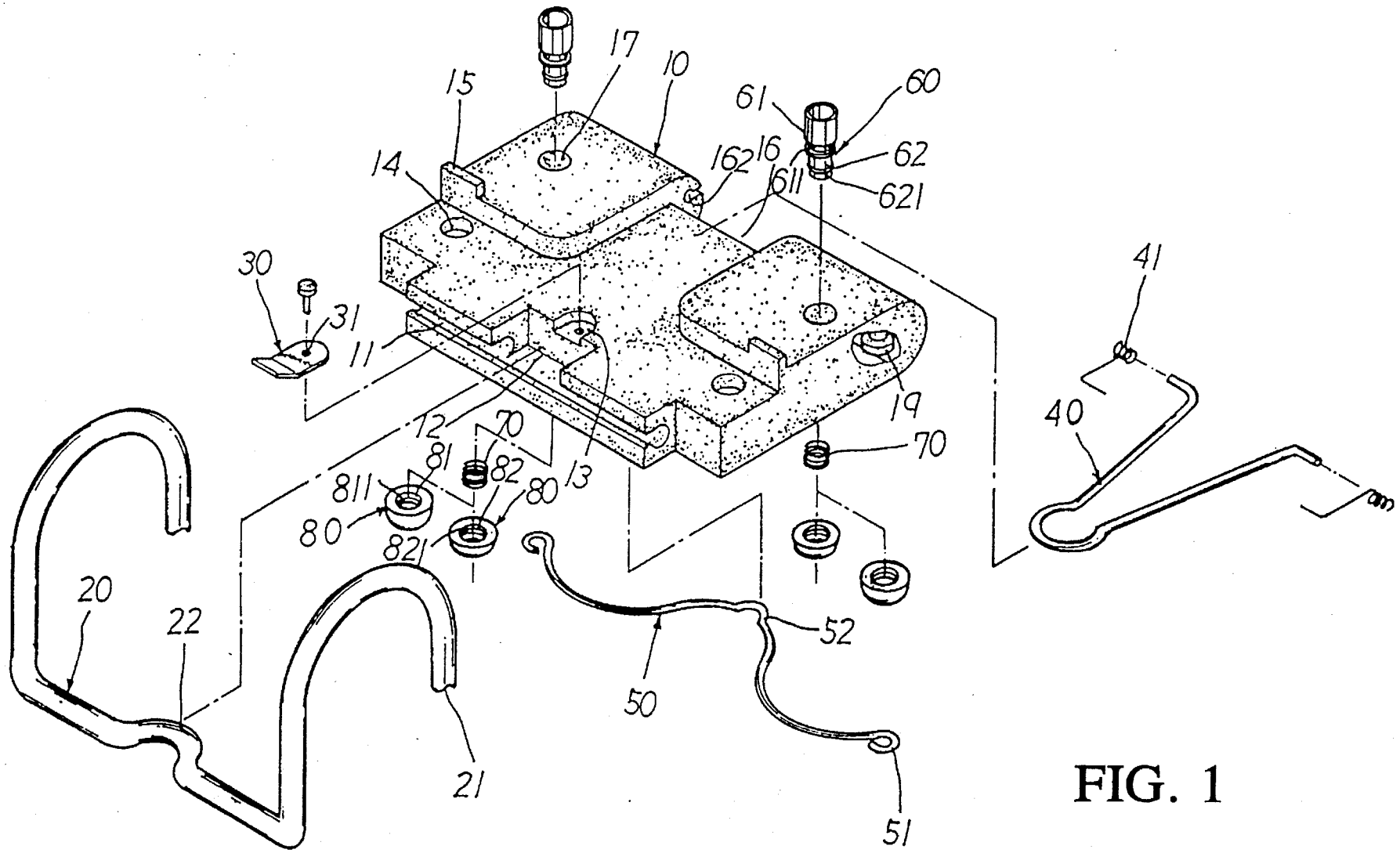
FIG. 1 is a perspective exploded view of the present invention.
Figure 2:
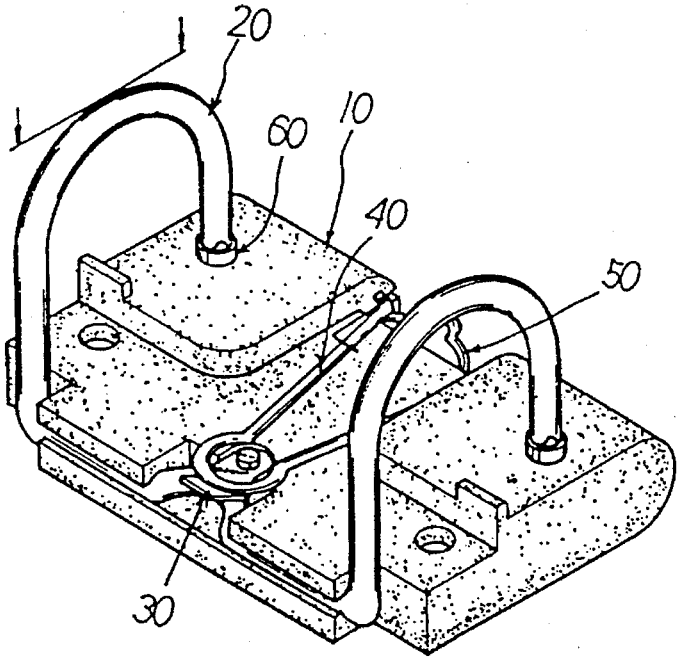
FIG. 2 is a perspective assembled view of the present invention.
Figure 3:
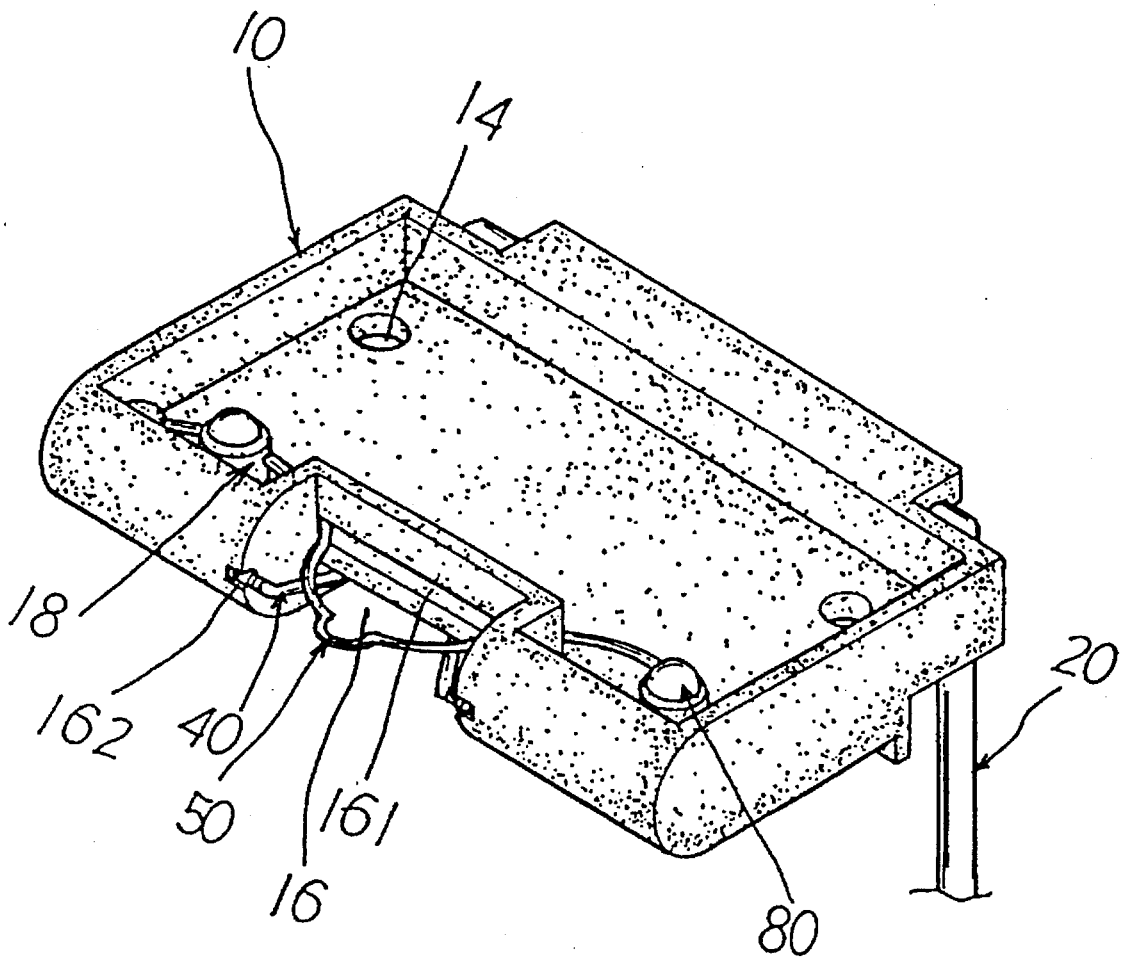
FIG. 3 is a perspective assembled view of the present invention, showing the back side thereof.

Please refer to FIGS. 1 to 3. The file clip of the present invention mainly includes a base board 10, a paper hanging member 20, a leaf spring 30 for fixing the paper hanging member 20, a paper clip member 40, two locating springs 41 for locating the paper clip member 40, a wave spring 50, two punching rods 60, two extension springs 70 and two transparent plastic caps 80. The base board 10 is formed with a pivot channel 11 at rear end for pivotally receiving the paper hanging member. At an upper middle section of the rear end of the base board 10 is formed a fixing recess 12 for fixing the paper hanging member. A fixing dent 13 is formed in front of the fixing recess 12. Two fixing holes 14 are formed on two sides of the rear end of the base board 10 for fixing the file clip on a wooden board or the like. Two stopper blocks 15 are disposed on two sides of the upper face of the base board 10 and a notch 16 is formed at a middle section of the front end of the base board 10. A slit 161 is formed at a middle section of inner side of the notch 16. Two locating channels 162 are respectively formed on two sides of the notch 16 for pivotally connecting with the paper clip member. Two punching holes 17 are formed on two sides of the upper face of the front end of the base board 10. Two punching seats 18 extend downward from the punching holes 17. A cavity 181 is formed at a top edge of each punching seat 18 and a through hole 182 is formed on a bottom face thereof. Two engaging tenons 19 are disposed on the bottom face of the base board 10 on outer sides of the punching seats 18. Two punching sections 21 are formed at two ends of the paper hanging member 20 and a lug section 22 is formed at a middle section thereof. The leaf spring 30 is formed with a rivet hole 31 at one end. The wave spring 50 is formed with two fixing circles 51 at two ends and a depression hanging hook 52 at a middle section. The punching rod 60 is hollow, having an upper large diameter section 61 and a lower small diameter section 62. An annular groove 611 is formed on a lower portion of the large diameter section 62 and an annular rib 621 is formed on a lower portion of the small diameter section 62. The plastic cap 80 is formed with a circular sink 81 or hole 82. An annular groove 811 (821) is formed on upper inner wall of the circular sink 81 or hole 82.

Figure 2A:
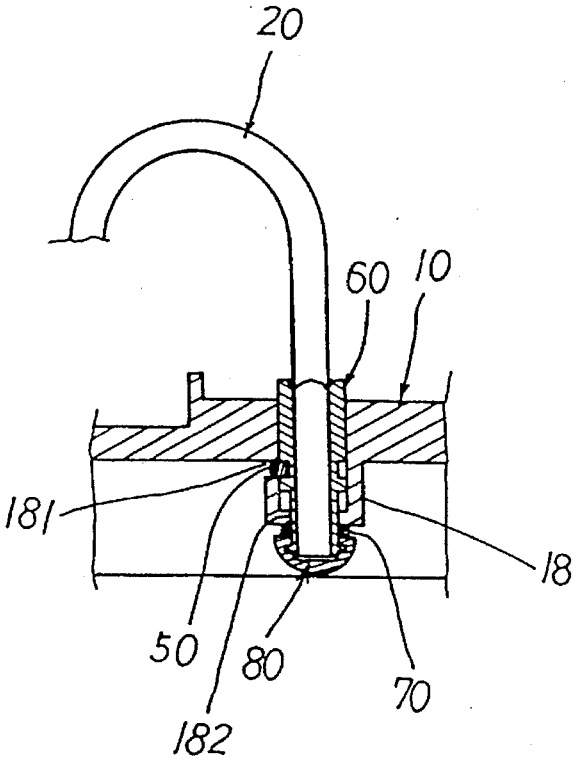
FIGS. 2A and 2B are sectional views showing the engagement between the paper hanging member and the punching seals of the base board.
Figure 2B:
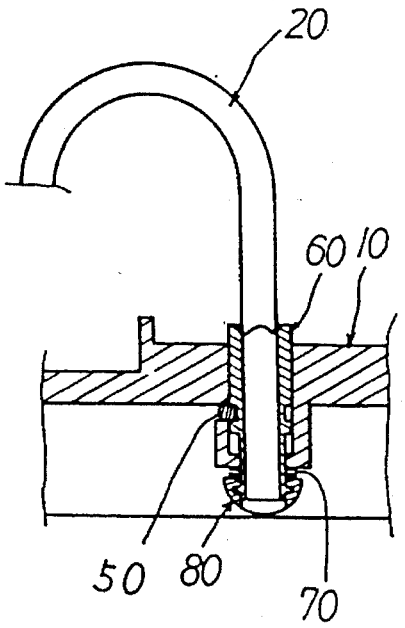

Please refer to FIGS. 2, 2A and 2B. When assembled, the punching rods 60 are first fitted into the punching holes 17 of the base board 10 with the small diameter sections 62 passing through the through holes 182 of the punching seats 18. An extension spring 70 is fitted around the small diameter section 62 of each punching rod 60 and a plastic cap 80 is fitted around the bottom end of the small diameter section 62 with the annular rib 621 engaged in the annular groove 811 (821) of the circular sink 81 (hole 82) of the plastic cap 80. The fixing circles 51 of the wave spring 50 are fitted on the engaging tenons 19 of the base board 10 with the depression hanging hook 52 extending out of the slit 161 of the notch 16 of the base board 10. Two ends of the wave spring 50 are engaged in the cavities 181 of the punching seats 18. The lug section 22 of the paper hanging member 20 is positioned in the fixing recess 12 of the base board 10. The leaf spring 30 is riveted in the fixing dent 13 of the base board 10 by means of the rivet hole 31 to press against and fix the lug section 22 of the paper hanging member 20. Two ends of the paper clip member 40 are fitted with two locating springs 41 and then fitted into the locating channels 162 on two sides of the notch 16. The plastic caps 80 are depressed to drivingly shift the punching rods 60 upward, making the upper ends of the extension springs 70 abut against the bottom faces of the punching seats 18 and the lower ends thereof contracted by the plastic caps 80. At this time, the two ends of the wave spring 50 are engaged in the annular grooves 611 of the large diameter section 61 of the punching rods 60. Therefore, the punching rods 60 are fixed and the extension springs 70 are fixed in a contracted state. Meanwhile, the punching sections 21 of the two ends of the paper hanging member 20 are inserted into the upper openings of the punching rods 60 by a certain depth to complete the assembly.

Figure 4:
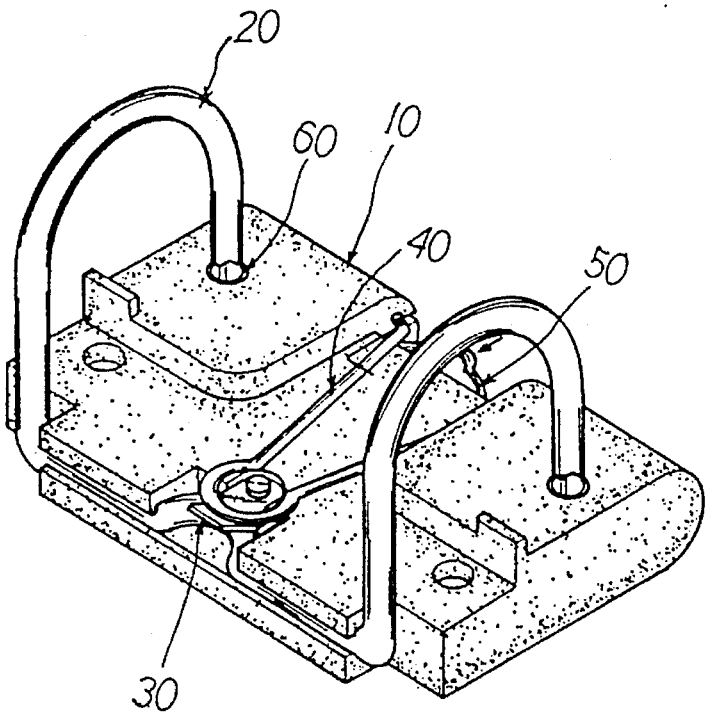
FIG. 4 is a perspective view showing the operation of the present invention.
Figure 4A:
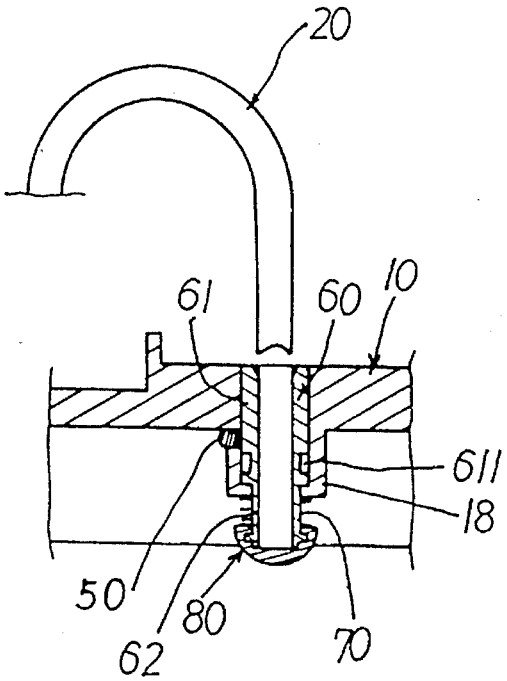
FIG. 4A is a sectional view according to FIG. 4.

Please refer to FIGS. 4 and 4A. When used, the depression hanging hook 52 of the wave spring 50 is first depressed inward to make two ends thereof separated from the annular grooves 611 of the large diameter sections 61 of the punching rods 60. At this time, the punching rods 60 and the plastic caps 80 are shifted downward by the resilient force of the extension springs 70 until the bottom faces of the large diameter sections 61 abut against the inner bottom faces of the punching seats 18. Meanwhile, the two ends of the wave spring 50 are respectively engaged in the cavities 181 of the punching seats 18.

Figure 5:
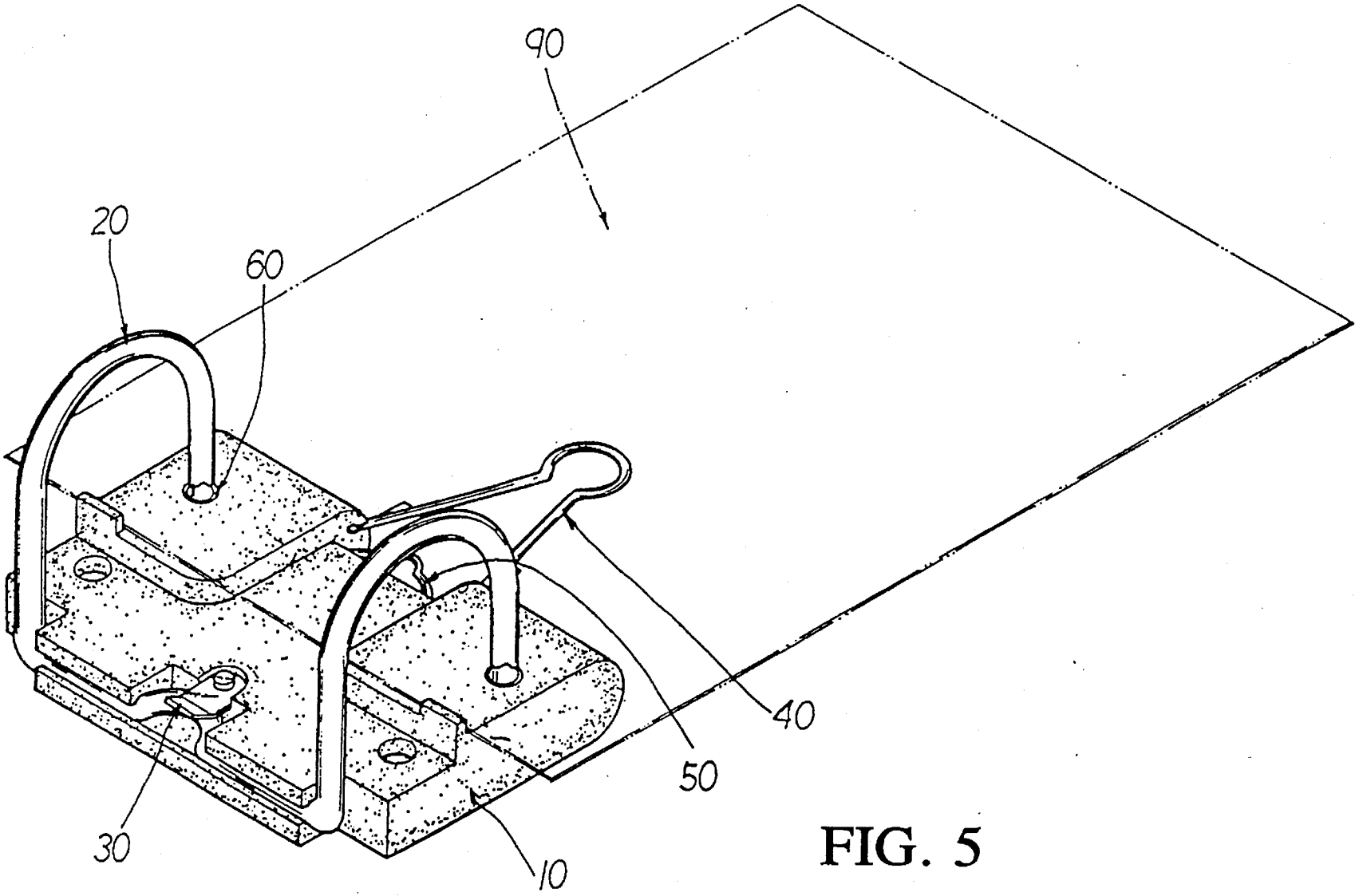
FIG. 5 is a perspective view showing that a paper is placed on the base board to be punched.

Please refer to FIG. 5. The paper clip member 40 is first turned over through 180 degrees to make two ends of the paper clip member 40 engaged and fixed in the locating channels 162 of the base board 10. Then the paper 90 is placed on the front end of the upper face of the base board 10 with the upper end of the paper 90 abutting against the stopper blocks 15.

Figure 6:
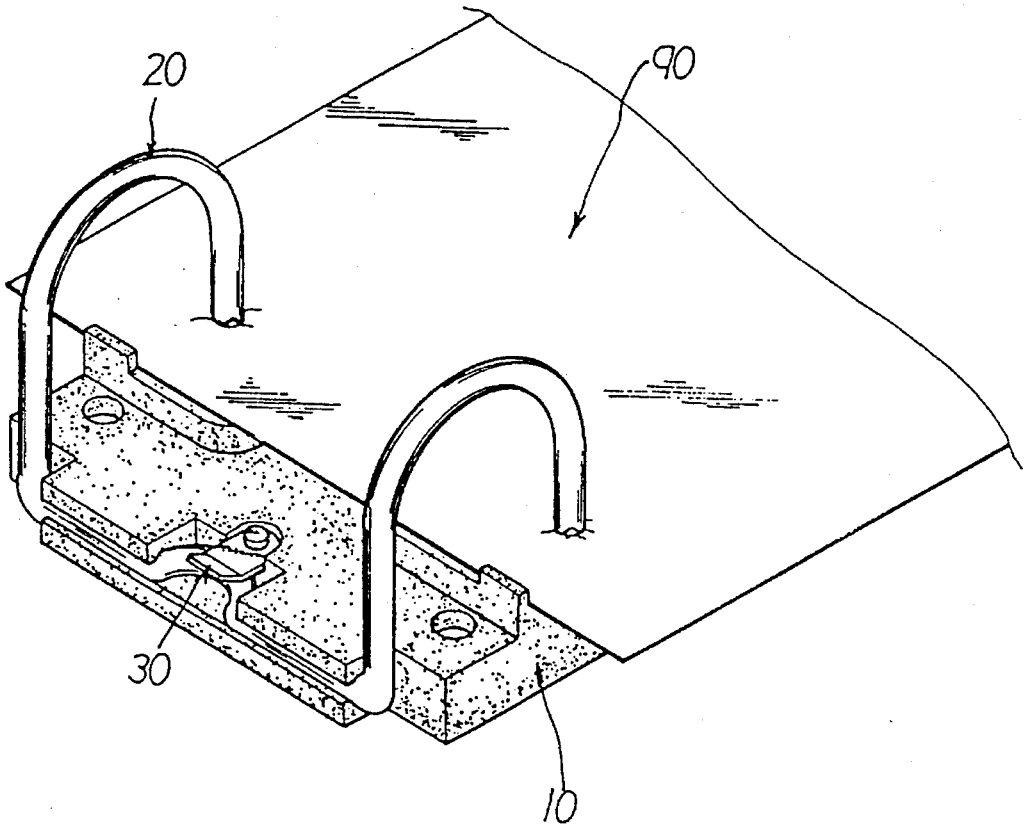
FIG. 6 is a perspective view showing that the paper is punched by the punching sections of the paper hanging member.
Figure 6A:
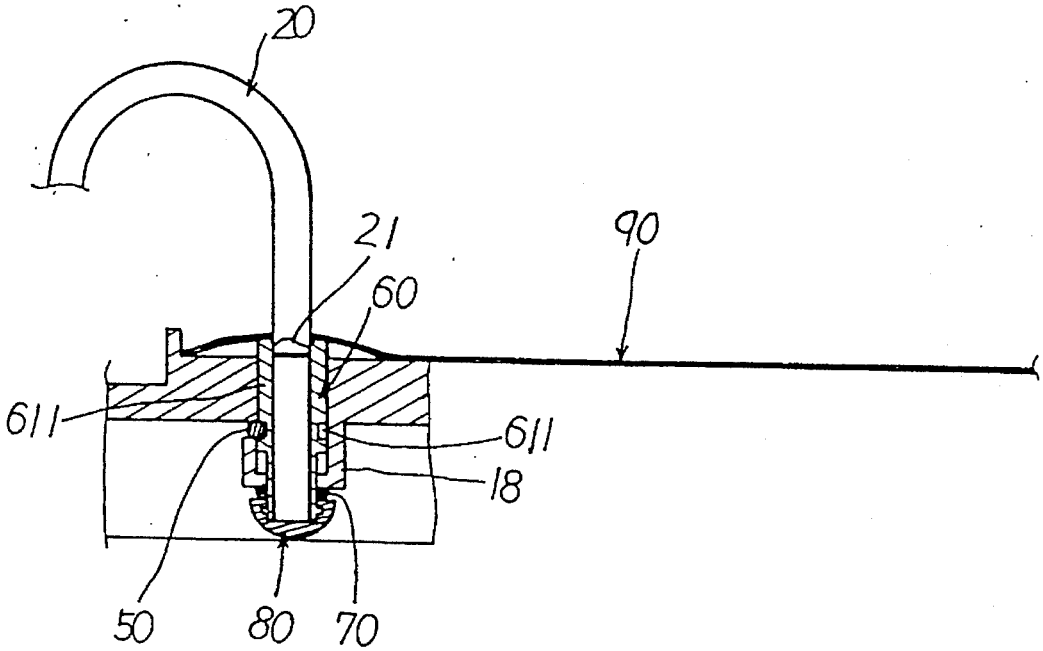
FIG. 6A is a sectional view according to FIG. 6.

Please refer to FIGS. 6 and 6A. The paper hanging member 20 is depressed downward to make the base board 10 move downward until the plastic caps 80 abut against the desk face. At this time, the punching rods 60 are moved upward to push the paper 90 upward so that the punching sections 21 of the paper hanging member 20 cooperate with the upper openings of the punching rods 60 to punch two holes on the paper 90. The punched paper chips drop into the circular sinks 81 of the plastic caps 80. The plastic caps 80 can be taken away to remove the accumulated paper chips. Meanwhile, the two ends of the wave spring 50 are resiliently engaged in the annular grooves 611 of the large diameter section 61 of the punching rods 60 so as to fix the punching rods 60 and keep the extension springs 70 in the contracted state. Also, the punching sections 21 of the paper hanging member 20 are inserted in the upper openings of the punching rods 60 by a certain depth.

Figure 7:
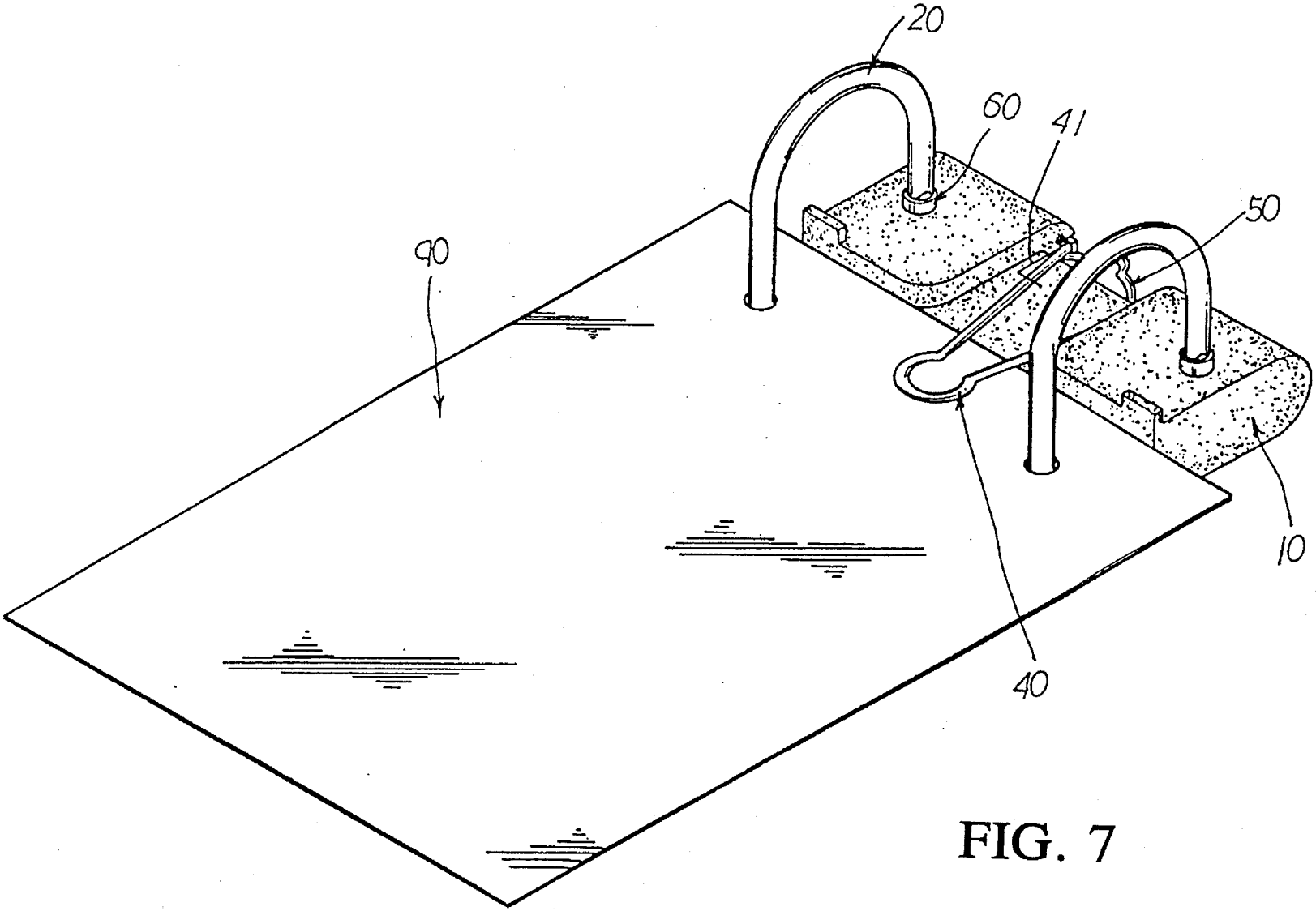
FIG. 7 is a perspective view showing that the paper is clipped by the paper clip member.

Please refer to FIG. 7. The punched paper 90 is directly turned over about the paper hanging member 20 to the rear side of the upper face of the base board 10 with the upper end of the paper 90 abutting against the rear sides of the stopper blocks 15. Then the two ends of the paper clip member 40 are forced inward and separated from the locating channels 162 of the base board 10. Then the paper clip member 40 is turned over through 180 degrees to by means of the locating springs 41 at two ends thereof exert a downward pressing force onto the upper portion of the paper 90.

Figure 8:
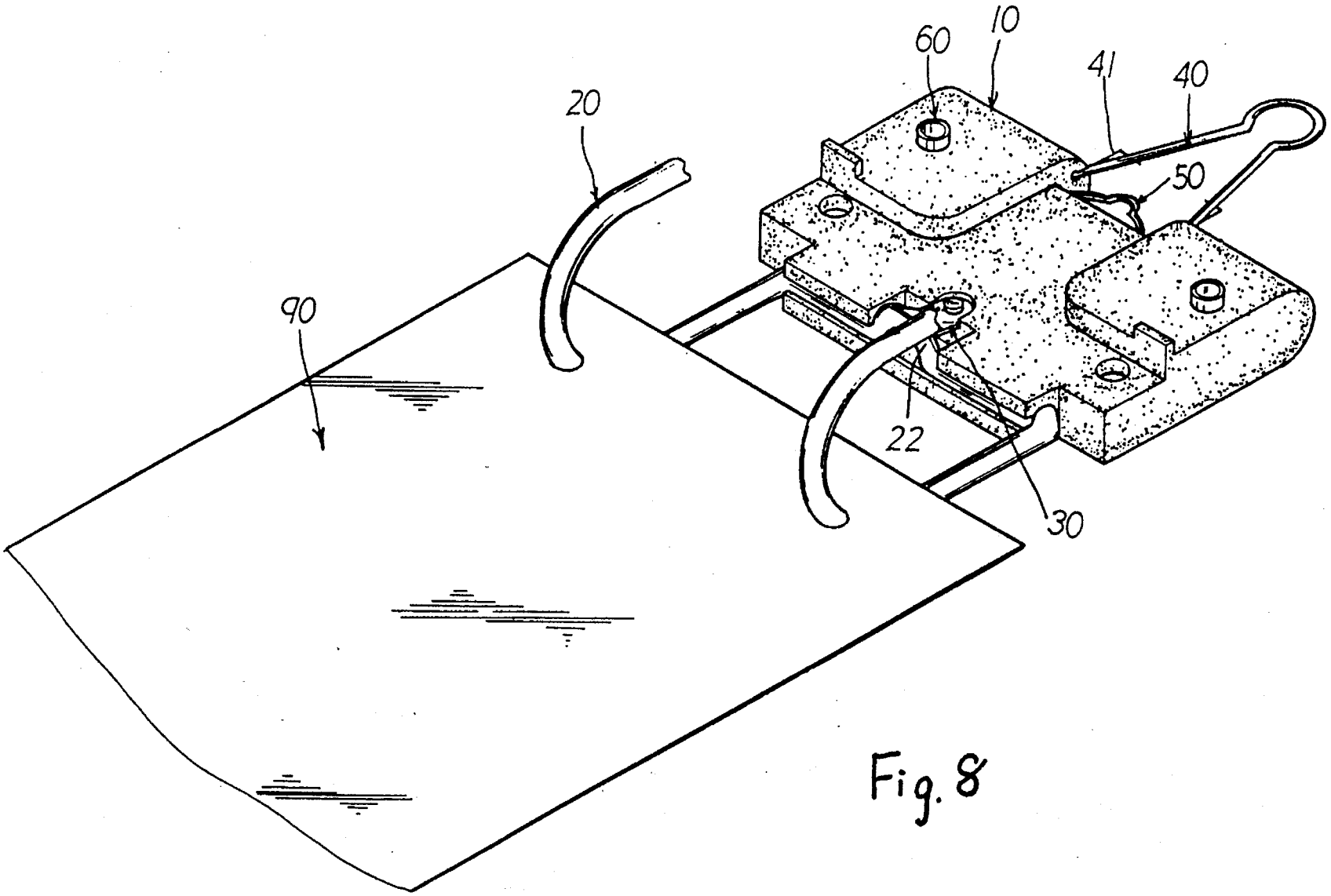
FIG. 8 is a perspective view showing that the paper is taken out from the file clip.

Please refer to FIG. 8. When taking the paper 90 collected by the file clip, the paper hanging member 20 is turned over through 90 degrees to make the lug section 22 push away the leaf spring 30. At this time, the paper 90 can be easily taken out from two ends of the paper hanging member 20. Thereafter, the paper hanging member 20 is reversely turned over through 90 degrees back to its home position.

According to the above arrangements, the present invention has the advantages as follows:

1. The file clip can also punch the paper in a simple manner so as to directly collect the paper on the file clip.

2. The file clip has relatively large opening so that the paper can be more easily collected or taken out.

The above embodiment is only an example of the present invention and the scope of the present invention should not be limited to the example. Any modification or variation derived from the example should fall within the scope of the present invention.

What is claimed is:

1. A file clip with punching function, comprising a base board, a paper hanging member, a leaf spring for fixing the paper hanging member, a paper clip member, two locating springs for locating the paper clip member, a wave spring, two punching rods, two extension springs and two transparent plastic caps, wherein:

the base board is formed with a pivot channel at rear end for pivotally receiving the paper hanging member, at an upper middle section of the rear end of the base board being formed a fixing recess for fixing the paper hanging member, a fixing dent being formed in front of the fixing recess, two fixing holes being formed on two sides of the rear end of the base board for fixing the file clip, two stopper blocks being disposed on two sides of the upper face of the base board and a notch being formed at a middle section of the front end of the base board, a slit being formed at a middle section of inner side of the notch, two locating channels being respectively formed on two sides of the notch for pivotally connecting with the paper clip member, two punching holes being formed on two sides of the upper face of the front end of the base board, two punching seats extending downward from the punching holes, a cavity being formed at a top edge of each punching seat and a through hole being formed on a bottom face thereof, two engaging tenons being disposed on the bottom face of the base board on outer sides of the punching seats;

two punching sections are formed at two ends of the paper hanging member and a lug section is formed at a middle section thereof;

the leaf spring is formed with a rivet hole at one end;

the wave spring is formed with two fixing circles at two ends and a depression hanging hook at a middle section;

the punching rod is hollow, having an upper large diameter section and a lower small diameter section, an annular groove being formed on a lower portion of the large diameter section and an annular rib being formed on a lower portion of the small diameter section;

the plastic cap is formed with a circular sink, an annular groove being formed on upper inner wall of the circular sink; and when assembled, the punching rods are first fitted into the punching holes of the base board with the small diameter sections passing through the through holes of the punching seats, an extension spring being fitted around the small diameter section of each punching rod and a plastic cap being fitted around the bottom end of the small diameter section with the annular rib engaged in the annular groove of the circular sink of the plastic cap, the fixing circles of the wave spring being fitted on the engaging tenons of the base board with the depression hanging hook extending out of the slit of the notch of the base board, two ends of the wave spring being engaged in the cavities of the punching seats, the lug section of the paper hanging member being positioned in the fixing recess of the base board, the leaf spring being riveted in the fixing dent of the base board by means of the rivet hole to press against and fix the lug section of the paper hanging member, two ends of the paper clip member being fitted with two locating springs and then fitted into the locating channels on two sides of the notch, the plastic caps being depressed to drivingly shift the punching rods upward, making the extension springs contracted by the plastic caps, the two ends of the wave spring being engaged in the annular grooves of the large diameter section of the punching rods so that the punching rods are fixed and the extension springs are fixed in a contracted state, the punching sections of the two ends of the paper hanging member being inserted into the upper openings of the punching rods by a certain depth.

2. A file clip as claimed in claim 1, wherein the circular sink of the plastic cap is replaced by a circular hole and an annular groove is formed on inner upper wall of the circular hole, whereby the punched paper chips directly drop through the circular holes out of the plastic cap.

* * * * *